US006131419A

United States Patent [19]

Rock et al.

[11] Patent Number: 6,131,419

[45] Date of Patent: Oct. 17, 2000

[54] TWO FACE CUT LOOP FABRIC

[75] Inventors: Moshe Rock, Andover; William K. Lie; Douglas Lumb, both of Methuen, all of Mass.

[73] Assignee: Malden Mills Industries, Inc., Lawrence, Mass.

[21] Appl. No.: 09/152,965

[22] Filed: Sep. 14, 1998

[51] Int. Cl.[7] ..... D04B 7/12

[52] U.S. Cl. ..... 66/194; 66/195; 28/162

[58] Field of Search ..... 66/84 R, 83, 203, 66/91, 136, 137, 169 R, 170, 171, 190, 191, 192, 194, 195; 442/304, 312, 313, 314, 318; 428/85, 89, 92; 28/159, 160, 161, 162, 170; 26/2 R, 15 R, 29 R

[56] References Cited

U.S. PATENT DOCUMENTS

| | | | |
|---|---|---|---|
| 3,152,381 | 10/1964 | Priester, Jr. et al. | 66/196 |
| 3,176,643 | 4/1965 | Spencer | 28/160 |
| 3,434,306 | 3/1969 | Auville et al. . | |
| 3,669,818 | 6/1972 | Stark | 28/160 |
| 3,854,098 | 12/1974 | Ploch et al. | 66/196 |
| 4,112,560 | 9/1978 | Willbanks | 28/160 |
| 4,255,321 | 3/1981 | Boba et al. | 28/160 |
| 4,554,801 | 11/1985 | Thore . | |
| 4,567,075 | 1/1986 | Krawczyk . | |
| 4,712,281 | 12/1987 | Scheller . | |
| 4,845,960 | 7/1989 | Schnegg . | |
| 4,986,090 | 1/1991 | Lombardi . | |
| 5,065,600 | 11/1991 | Byles . | |
| 5,186,025 | 2/1993 | Neher . | |
| 5,855,125 | 1/1999 | Lohmueller et al. | 66/196 |

*Primary Examiner*—Danny Worrell
*Attorney, Agent, or Firm*—Gottlieb Rackman & Reisman

[57] ABSTRACT

A cut loop fabric, knit on a conventional terry knitting machine utilizing a reverse plaiting technique, is provided. The fabric has a technical face with a raised or napped surface, and a technical back in which the sinker loops are sheared in order to form a cut loop velvet surface.

16 Claims, 2 Drawing Sheets

FIG. 2
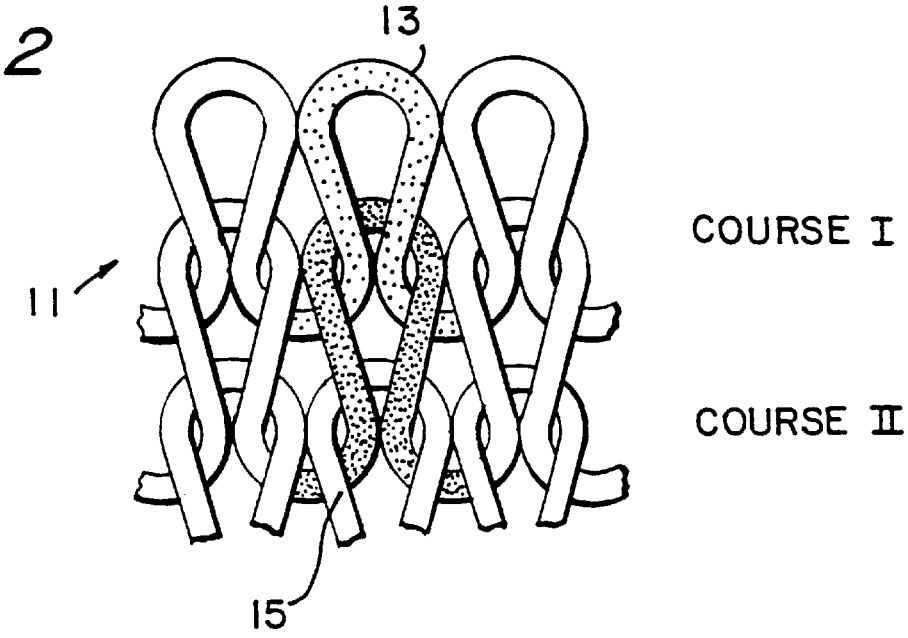
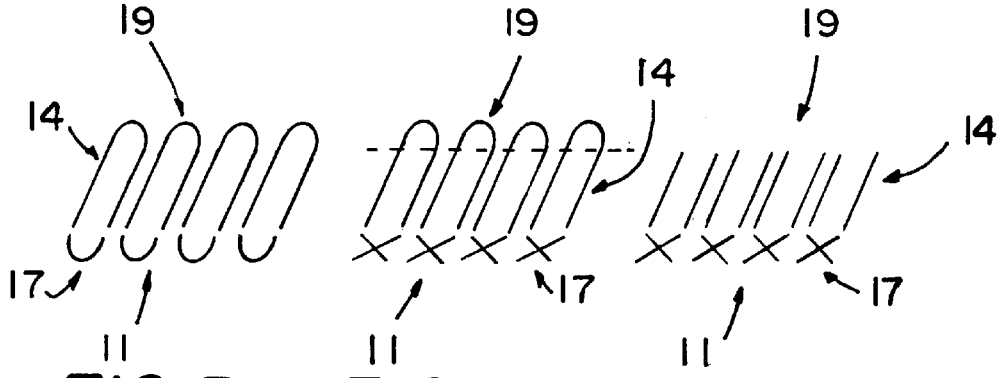
FIG. 3 FIG. 4 FIG. 5

TWO FACE CUT LOOP FABRIC

BACKGROUND OF THE INVENTION

This invention relates to a cut loop fabric which is knit on a standard terry knitting machine, and more particularly, to a terry knit cut loop fabric in which the technical face is napped, and the technical back is sheared.

In general, knitted terry fabrics are a variation of a jersey knit fabric whereby two yarns are fed simultaneously into the same needles. A plaiting technique is employed to knit the fabric which causes one yarn always to appear on the technical face, and the other yarn to always appear on the technical back. As the fabric is knitted, sinker loops are formed of one yarn, leaving the other yarn to serve as the ground.

It is well known to shear the terry loops of a terry constructed fabric in order to create a velvet effect. This is true whether the terry fabric has a circular knit construction, a warp knit construction or some other type of construction. For all these types of items, the technical back of the fabric is a velvet, with the technical face having a smooth surface.

Terry fabrics of the above construction, however, are less than desirable. In the first instance, such terry fabrics exhibit thermal properties which limit usage to warmer weather climates. In addition, they are inadequate in terms of removing moisture away from the skin, the effect being the clinging of the fabric to the skin.

Accordingly, it would be desirable to provide a cut loop terry fabric knit on a standard terry knitting machine which has improved thermal properties, as well as improved qualities with respect to luster, depth of color and finish.

SUMMARY OF THE INVENTION

Generally speaking, in accordance with the invention, a cut loop fabric, knit utilizing a reverse plaiting technique, is provided. The fabric has a technical face with a raised or napped surface, and a technical back in which the sinker loops are sheared in order to form a cut loop velvet surface.

The terry knit fabric of the invention may be knit on a circular knitting machine using a reverse plaiting technique such that the loop yarns are plaited around the stitch yarns. In one embodiment, the loop yarns are of a size of at least 50% greater than that of the stitch yarns. As a result, the loop yarn covers the stitch yarn so that upon napping the stitch yarn, fabric integrity is maintained.

The fabric of the invention has substantially more bulk as compared to conventional face cut loop terry fabric. As a result, air is trapped within the fabric, which provides for increased thermal insulation.

Accordingly, it is an object of the invention to provide a knit fabric in which the technical face has a raised surface, and the technical back has a cut loop surface.

Another object of the invention is to provide a cut loop terry fabric having improved thermal insulative properties.

Yet a further object of the invention is preferably to provide a knit fabric in which the loop yarns are substantially greater in size than that of the stitch yarns.

Still other objects and advantages of the invention will in part be obvious and will in part be apparent from the following description.

The invention accordingly comprises the features of construction, combination of elements and arrangement of parts as hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 2 is a front elevational view of the terry fabric construction viewed from its technical face;

FIG. 3 is a side view showing the terry loops of the inventive fabric construction prior to (a) napping on the technical face and (b) shearing on the technical back;

FIG. 4 is a side view of the terry loops of the fabric construction after a napping process has been applied to the technical face; and FIG. 5 is a side view of the terry loops of the fabric construction after the loops of the technical back have been sheared.

DETAILED DESCRIPTION OF THE PREFERRED EMBODIMENT

Figure 1:
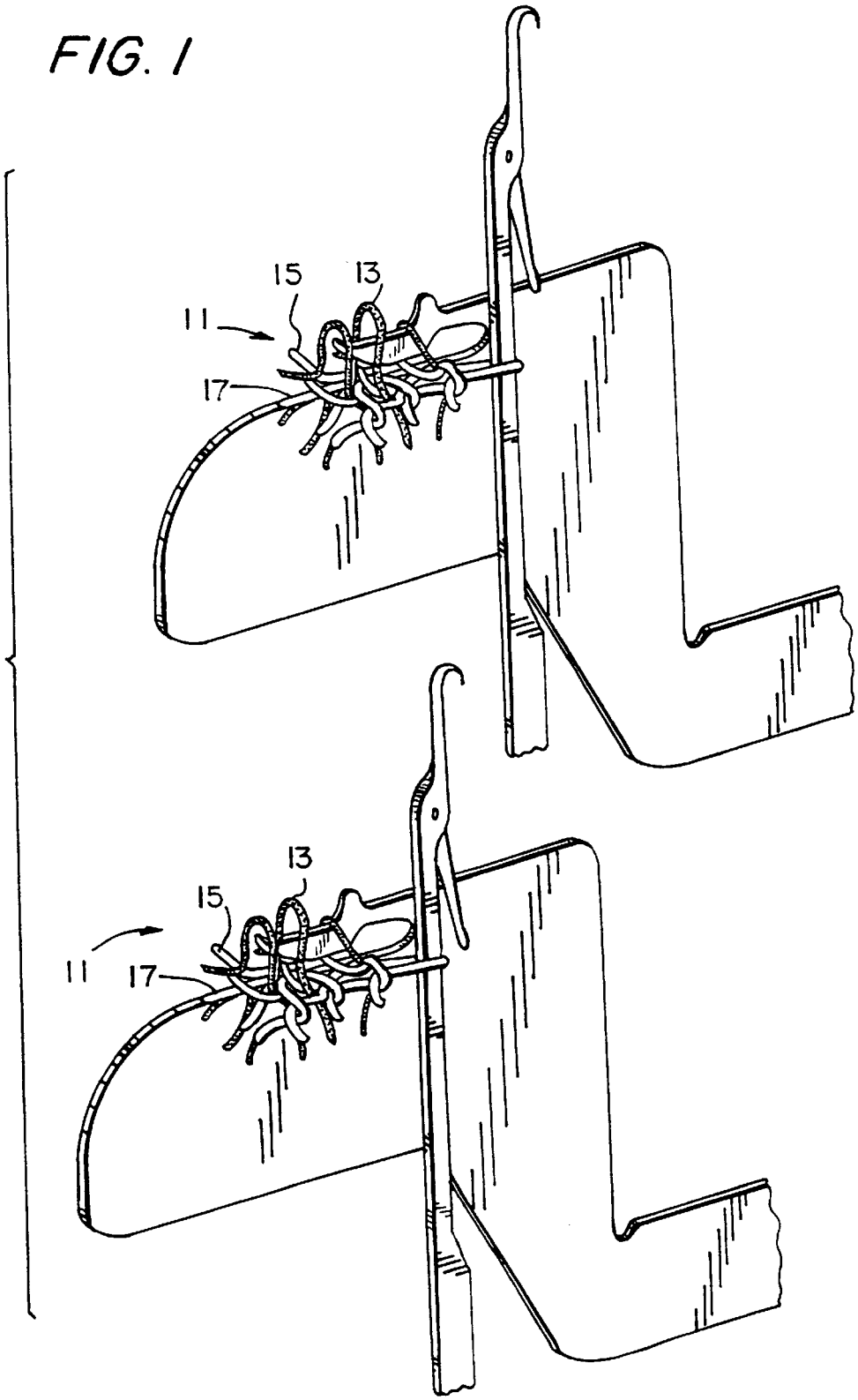
FIG. 1 is a perspective view of the terry fabric construction according to the invention viewed from its technical back and illustrating formation of the sinker loops.

Referring now first to FIGS. 1 and 2, a raised surface fabric made in accordance with the invention is generally indicated at 11. Fabric 11 includes a plurality of courses of loop yarn 13 integrated with stitch or backing yarn 15. As can be appreciated, loop yarn 13 is plaited around stitch yarn 15 in order to define a plurality of fabric loops 14 (FIG. 3). Fabric 11 comprises a circular knit reverse plaited construction which is suitable for generating a two face surface fabric, as described below.

Significantly, loop yarn 13 has a bulk which is at least 50% greater than that of stitch yarn 15. In particular, loop yarn 13 has a denier of between about 150 and 600, whereas stitch yarn 15 has a denier of between about 30 and 150. Loop yarn 13 is preferably made from 100% polyester. Loop yarn 13 may be also made from acrylic or nylon. Stitch yarn 15 is made from polyester or nylon.

Once fabric 11 is produced, as shown in FIG. 3, technical face 17 is napped or otherwise raised (FIG. 4). The napping process is carried out in order to maintain full loop coverage with minimal distortion of technical back 19. In particular, during the napping process, the integrity of loop yarn 13 on technical back 19 is to some extent compromised, as it is pulled shorter, due to the napping process. Accordingly, in order to be able to shear loops 14 along technical back 19 once the napping process is completed, loop yarn 13 must be knit longer utilizing sinker loops of at least 2.0 mm.

Once the napping or raising process has been finished, loops 14 along technical back 19 are sheared, as shown in FIG. 5. Significantly, the shearing step must take place after the napping step. If shearing took place as the first fabric finishing step, as is usual for standard single face cut loop fabrics, the cut loops 14 would be pulled through the back to the face during any subsequent napping process.

The finished fabric of the invention has significantly more bulk as compared to conventional greige knit fabrics, including single face cut loop versions of such fabrics. This additional bulk enables the inventive fabric to have improved heat insulating properties.

In addition, the cut loop surface of the fabric of the invention exhibits higher luster and color depth compared to the luster and color depth of the raised surface of the fabric of the invention and compared to the luster and color depth of a conventional two faced raised surface fleece velour.

Further, the fabric of the invention exhibits a smoother appearance of the cut loop surface after repeated washing compared to the clumped appearance of a conventional two faced raised surface fleece velour after washing.

The fabric of the invention may be knit on a standard terry knitting machine or on a jacquard machine, the latter enabling the production of different height fabric loops along the technical back of the fabric.

It will thus be seen that the objects set forth above, among those made apparent from the preceding description, are efficiently attained, and, since certain changes may be made in the invention without departing from its spirit and scope, it is the following claims which define the inventive scope.

What is claimed is:

1. A mechanically finished knit fabric comprising a reverse plaited fabric construction having a technical face and a technical back and having loop yarn plaited around stitch yarn in order to define a plurality of single loops of at least 2.0 mm on the technical back, wherein only the technical face of the fabric construction has a surface that is raised, and the technical back of the fabric construction has a surface that is sheared without raising the surface of the technical back.

2. The fabric of claim 1, wherein said loop yarn has a bulk of at least 50% greater than that of said stitch yarn.

3. The fabric of claim 1, wherein said loop yarn is made from a material selected from the group consisting of polyester, acrylic and nylon.

4. The fabric of claim 4, wherein said material is 100% polyester.

5. The fabric of claim 1, wherein said loop yarn has a denier of between about 150 and 600, and said stitch yarn has a denier of between about 30 and 150.

6. The fabric of claim 1, wherein said fabric loops along said technical back have at least two different heights.

7. A method of producing a two-face fabric construction comprising:

knitting a fabric utilizing a reverse plaiting technique in which loop yarn is plaited around stitch yarn such that said loop yarn is knit utilizing sinker loops of at least 2.0 mm in order to define a technical face and a technical back;

first raising the surface of the technical face, and then without raising the surface of the technical back, shearing the surface of the technical back.

8. The method of claim 7, wherein said raising step is carried out by applying a napping process to said surface of said technical face.

9. The method of claim 7, wherein said shearing step is carried out by cutting along a plurality of fabric loops made from said loop yarns and extending from said technical back.

10. A terry knit fabric knit on a circular terry knitting machine using a reverse plaiting technique, said fabric comprising a loop yarn plaited around stitch yarn for producing a plurality of loops of at least 2.0 mm and thereby defining a technical face with a raised surface and a technical back in which the plurality of loop yarns are sheared without raising the loops along the technical back in order to form a cut loop velvet surface.

11. The fabric of claim 10, wherein the loop yarn has a bulk that is at least 50% greater than that of said stitch yarn.

12. The fabric of claim 10, wherein the loop yarn has a denier of between about 150 and 600 and the stitch yarn has a denier of between about 30 and 150.

13. The fabric of claim 10, wherein said loop yarn covers said stitch yarn.

14. The product produced by the method of claim 7.

15. The product produced by the method of claim 8.

16. The product produced by the method of claim 9.

* * * * *

UNITED STATES PATENT AND TRADEMARK OFFICE

CERTIFICATE OF CORRECTION

PATENT NO. : 6,131,419 
DATED : October 17, 2000
INVENTOR(S) : Moshe Rock, William K. Lie and Douglas Lumb It is certified that error appears in the above-identified patent and that said Letters Patent is hereby corrected as shown below:

Title page,
Item [60], please add:
-- [60] Related U.S. Application Data
Provisional application No. 60/083,669, Apr. 29, 1998. --

Column 1,
Line 2, please add: -- This application claims benefit of U.S. Provisional Application No. 60/083,669, filed April 29, 1998. --

Signed and Sealed this

Eighteenth Day of March, 2003

JAMES E. ROGAN
*Director of the United States Patent and Trademark Office*